US011788251B2

(12) United States Patent
Parzynski, Jr. et al.

(10) Patent No.: US 11,788,251 B2
(45) Date of Patent: Oct. 17, 2023

(54) ADAPTER BOARD BOLTED JOINT SURFACE

(71) Applicant: Caterpillar Inc., Peoria, IL (US)

(72) Inventors: David Bruno Parzynski, Jr., Peoria, IL (US); Thomas Marshall Congdon, Dunlap, IL (US); Susan Marie Graham, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 277 days.

(21) Appl. No.: 17/077,159

(22) Filed: Oct. 22, 2020

(65) Prior Publication Data

US 2021/0040707 A1 Feb. 11, 2021

Related U.S. Application Data

(63) Continuation of application No. 15/952,421, filed on Apr. 13, 2018, now Pat. No. 10,889,959.

(51) Int. Cl.
*E02F 3/815* (2006.01)
*E02F 9/28* (2006.01)

(52) U.S. Cl.
CPC ..... *E02F 3/8152* (2013.01); *E02F 9/2825* (2013.01)

(58) Field of Classification Search
CPC ..... E02F 3/8152; E02F 9/2825
USPC ..... 172/701.3
See application file for complete search history.

(56) References Cited

U.S. PATENT DOCUMENTS 2,310,396 A * 2/1943 Clinksacles, Jr. ..... E02F 3/8152 172/701.3
2,634,664 A 4/1953 Benner
2,866,280 A 12/1958 O'Conner
2,887,797 A 5/1959 O'Conner
3,021,626 A 2/1962 Eyolfson
3,685,177 A 8/1972 Hahn et al.
3,845,578 A * 11/1974 Holmstrom ..... E02F 9/2833 403/380
3,864,853 A * 2/1975 Klett et al. ..... E02F 9/2841 172/753
3,934,654 A * 1/1976 Stephenson et al. ... E02F 9/285 172/701.3
3,995,384 A * 12/1976 Wood ..... E02F 3/8152 172/753
4,501,079 A * 2/1985 Hahn et al. ..... E02F 9/2841 24/456
4,753,299 A * 6/1988 Meyers ..... E02F 3/8152 172/701.3
4,770,253 A 9/1988 Hallissy et al.
4,883,129 A * 11/1989 Lonn et al. ..... E21C 35/183 172/701.3

(Continued)

FOREIGN PATENT DOCUMENTS

CA 940298 A 1/1974
CN 104334007 A 10/2017

(Continued)

*Primary Examiner* — Thomas B Will
*Assistant Examiner* — Joel F. Mitchell

(57) ABSTRACT

An adapter board defines an upper adapter board attachment portion, and a lower tool bit attachment portion. The upper adapter board attachment portion includes a first peak surface and a second peak surface, the first peak surface and the second peak surface forming a first valley between the first peak surface and the second peak surface.

20 Claims, 4 Drawing Sheets

(56) References Cited

U.S. PATENT DOCUMENTS

| | | | | |
|---|---|---|---|---|
| 5,809,760 | A * | 9/1998 | Rexroat | E02F 3/8152 56/400.05 |
| 6,003,617 | A | 12/1999 | McSweeney et al. | |
| 9,732,495 | B2 | 8/2017 | Congdon | |
| 9,957,691 | B2 | 5/2018 | Congdon et al. | |
| 2015/0060098 | A1 | 3/2015 | Pohl | |

FOREIGN PATENT DOCUMENTS

| | | | |
|---|---|---|---|
| CN | 106659115 | A | 6/2019 |
| FR | 1500849 | | 11/1967 |
| GB | 1104948 | A | 3/1968 |

* cited by examiner

ADAPTER BOARD BOLTED JOINT SURFACE

CROSS-REFERENCE TO RELATED APPLICATIONS

This application is a continuation application of application Ser. No. 15/952,421 filed on Apr. 13, 2018, entitled "Adapter Board Bolted Joint Surface", claiming priority thereto and incorporating its contents by reference in its entirety.

TECHNICAL FIELD

The present disclosure relates to cast serrated cutting edges formed by replaceable bits used by motor graders or other similar equipment. More specifically, the present disclosure relates to the bolted joint interface between an adapter board, to which bits may be attached, and the moldboard that connects the adapter board and bits to the machine.

BACKGROUND

Machines such as motor graders employ a long blade that is used to level work surfaces during the grading phase of a construction project or the like. These blades often encounter abrasive material such as rocks, dirt, etc. that can degrade the working edge, making such blades ineffective for their intended purpose. Some blades have a serrated cutting edge meaning that the edge is not continuously flat but undulates up and down, forming teeth. A drawback to such blades is that the teeth may be more easily worn than is desired. In harsh environments, such blades may be rendered dull, with the teeth having been essentially removed, after 100-200 hours of operation. Necessitating their replacement. Serrated cutting edges are sometimes provided to improve penetration, etc.

Accordingly, devices have been developed that allow the teeth or bits that form the serrated cutting edges to be replaced. Typically, a moldboard extends downwardly from and is connected to the machine. An adapter board is attached to the to the moldboard and extends downwardly from the moldboard. So, the bottom free end of the adapter board is disposed adjacent the ground or other work surface. A plurality of bits are removably attached to the free end of the adapter board so that they may engage the ground or other work surface. Often, the surface that engages or mates with the moldboard is flat while the moldboard profile is curved. That is to say, the attachment portion of the adapter board may be straight while corresponding attachment portion of the moldboard is curved. As a result, when the adapter board is bolted onto the moldboard, the adapter point only contacts the moldboard at two points. If the bolt holes are machined improperly, such as if there is a 2° deviation, or if the bottom portion of the moldboard deflects during use, the bolted joint becomes loose, which may result in the adapter board falling off the moldboard undesirably over time, necessitating maintenance.

One proposed solution to this problem is disclosed in French Pat. No. 1,500,849A. FIG. 1 of this patent discloses an adapter board that is curved, matching the profile of the moldboard, ensuring alignment of the bolt holes of adapter board with those of the moldboard. However, machining such a curvature on the adapter board with the suitable precision may be expensive. In particular, a five-axis milling machine may be needed to provide such accuracy.

Accordingly, there exists a need for a bolted joint interface between a moldboard and an adapter board is warranted that may alleviate the aforementioned problems at a reduced cost.

SUMMARY OF THE DISCLOSURE

A blade assembly according to an embodiment of the present disclosure comprises a moldboard defining an upper moldboard free end and a lower moldboard free end, the lower moldboard free end defining a lower curved mounting surface, and an adapter board defining an upper adapter board attachment portion, terminating in an upper adapter board free end, and a lower tool bit attachment portion, terminating in a lower adapter board free end. The upper adapter board attachment portion may include a first peak surface and a second peak surface, the first peak surface and the second peak surface forming a first valley therebetween and being configured to contact the lower curved mounting surface.

A blade assembly according to an embodiment of the present disclosure comprises a moldboard defining an upper moldboard free end and a lower moldboard free end, the lower moldboard free end defining a lower curved mounting surface, and an adapter board defining an upper adapter board attachment portion, terminating in an upper adapter board free end, and a lower tool bit attachment portion, terminating in a lower adapter board free end. The upper adapter board attachment portion may include a plurality of peaks surfaces defining a plurality of valleys therebtween, the plurality of peak surfaces being differently configured than the lower curved mounting surface.

An adapter board according to an embodiment of the present disclosure comprises an upper adapter board attachment portion, terminating in an upper adapter board free end, and a lower tool bit attachment portion, terminating in a lower adapter board free end. The upper adapter board attachment portion may include a first flat surface disposed adjacent the upper adapter board free end, a second flat surface disposed beneath the first flat surface, and a third flat surface disposed below the first flat surface and above the second flat surface. The first flat surface and the second flat surface being non-parallel to each other.

DETAILED DESCRIPTION

Figure 1:
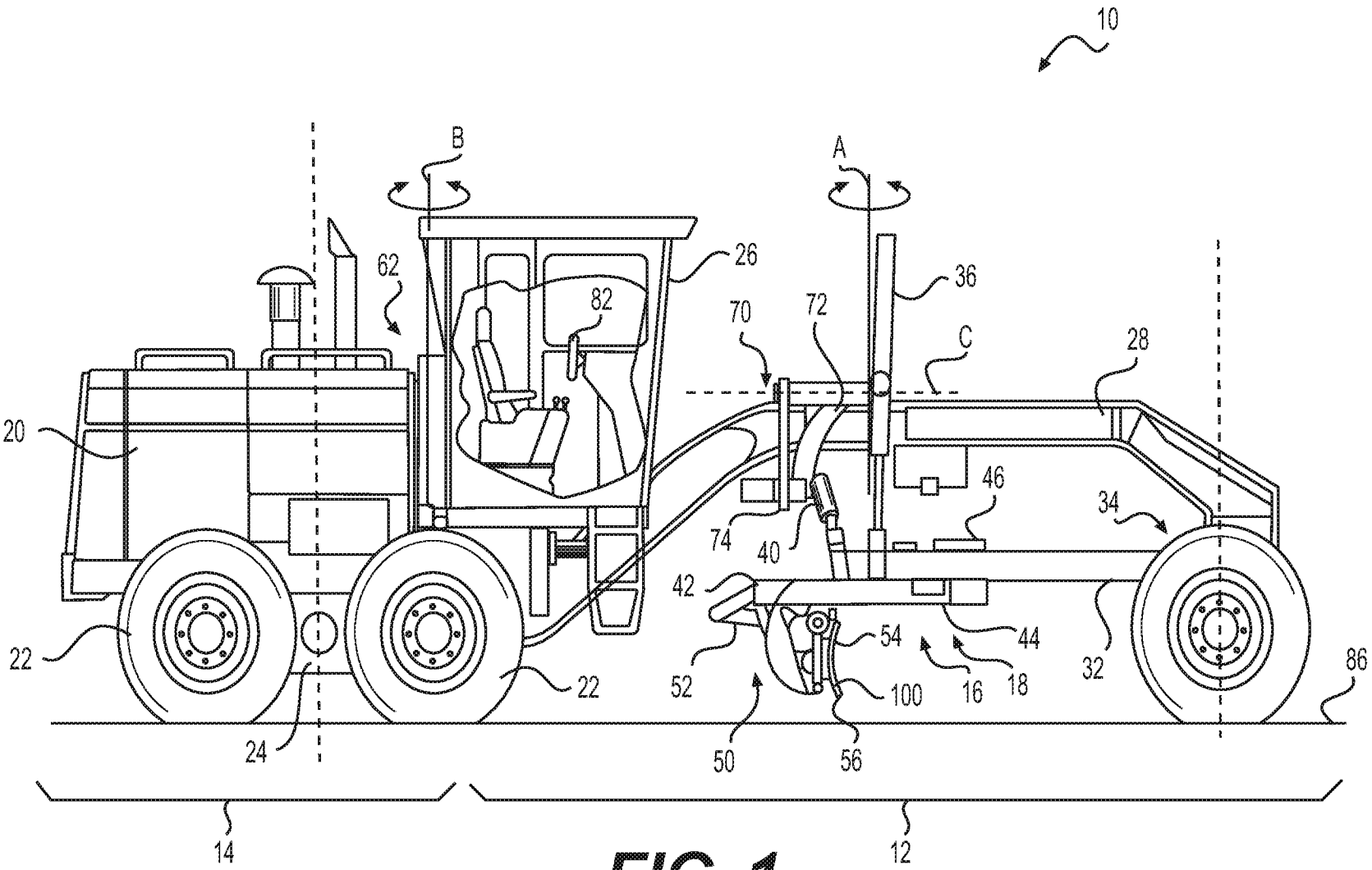
FIG. 1 is a side view of a motor grader that may employ an adapter board with a bolted joint surface according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A blade assembly with a bolted joint interface connecting an adapter board to a moldboard according to an embodiment of the present disclosure will be described later herein. Then, the adapter board with a bolted joint surface according to an embodiment of the present disclosure will be discussed.

First, a machine will now be described to give the reader the proper context for understanding how various embodiments of the present disclosure are used to level or grade a work surface. It is to be understood that this description is given as exemplary and not in any limiting sense. Any embodiment of an apparatus or method described herein may be used in conjunction with any suitable machine.

FIG. 1 is a side view of a motor grader in accordance with one embodiment of the present disclosure. The motor grader 10 includes a front frame 12, rear frame 14, and a work implement 16, e.g., a blade assembly 18, also referred to as a drawbar-circle-moldboard assembly (DCM). The rear frame 14 includes a power source (not shown), contained within a rear compartment 20, that is operatively coupled through a transmission (not shown) to rear traction devices or wheels 22 for primary machine propulsion.

As shown, the rear wheels 22 are operatively supported on tandems 24 which are pivotally connected to the machine between the rear wheels 22 on each side of the motor grader 10. The power source may be, for example, a diesel engine, a gasoline engine, a natural gas engine, or any other engine known in the art. The power source may also be an electric motor linked to a fuel cell, capacitive storage device, battery, or another source of power known in the art. The transmission may be a mechanical transmission, hydraulic transmission, or any other transmission type known in the art. The transmission may be operable to produce multiple output speed ratios (or a continuously variable speed ratio) between the power source and driven traction devices.

The front frame 12 supports an operator station 26 that contains operator controls 82, along with a variety of displays or indicators used to convey information to the operator, for primary operation of the motor grader 10. The front frame 12 also includes a beam 28 that supports the blade assembly 18 and which is employed to move the blade assembly 100 to a wide range of positions relative to the motor grader 10. The blade assembly 18 includes a drawbar 32 pivotally mounted to a first end 34 of the beam 28 via a ball joint (not shown). The position of the drawbar 32 is controlled by three hydraulic cylinders: a right lift cylinder 36 and left lift cylinder (not shown) that control vertical movement, and a center shift cylinder 40 that controls horizontal movement. The right and left lift cylinders are connected to a coupling 70 that includes lift arms 72 pivotally connected to the beam 28 for rotation about axis C. A bottom portion of the coupling 70 has an adjustable length horizontal member 74 that is connected to the center shift cylinder 40.

The drawbar 32 includes a large, flat plate, commonly referred to as a yoke plate 42. Beneath the yoke plate 42 is a circular gear arrangement and mount, commonly referred to as the circle 44. The circle 44 is rotated by, for example, a hydraulic motor referred to as the circle drive 46. Rotation of the circle 44 by the circle drive 46 rotates the attached blade assembly 100 about an axis A perpendicular to a plane of the drawbar yoke plate 42. The blade cutting angle is defined as the angle of the blade assembly 100 relative to a longitudinal axis of the front frame 12. For example, at a zero-degree blade cutting angle, the blade assembly 100 is aligned at a right angle to the longitudinal axis of the front frame 12 and beam 28.

The blade assembly 100 is also mounted to the circle 44 via a pivot assembly 50 that allows for tilting of the blade assembly 100 relative to the circle 44. A blade tip cylinder 52 is used to tilt the blade assembly 100 forward or rearward. In other words, the blade tip cylinder 52 is used to tip or tilt a top edge 54 relative to the bottom cutting edge 56 of the blade 30, which is commonly referred to as blade tip. The blade assembly 100 is also mounted to a sliding joint associated with the circle 44 that allows the blade assembly 100 to be slid or shifted from side-to-side relative to the circle 44. The side-to-side shift is commonly referred to as blade side shift. A side shift cylinder (not shown) is used to control the blade side shift. The placement of the blade assembly 100 allows a work surface 86 such as soil, dirt, rocks, etc. to be leveled or graded as desired. The motor grader 10 includes an articulation joint 62 that pivotally connects front frame 12 and rear frame 14, allowing for complex movement of the motor grader, and the blade.

U.S. Pat. No. 8,490,711 to Polumati illustrates another motor grader with fewer axes of movement than that just described with respect to FIG. 1. It is contemplated that such a motor grader could also employ a blade according to various embodiments of the present disclosure, etc.

Figure 2:
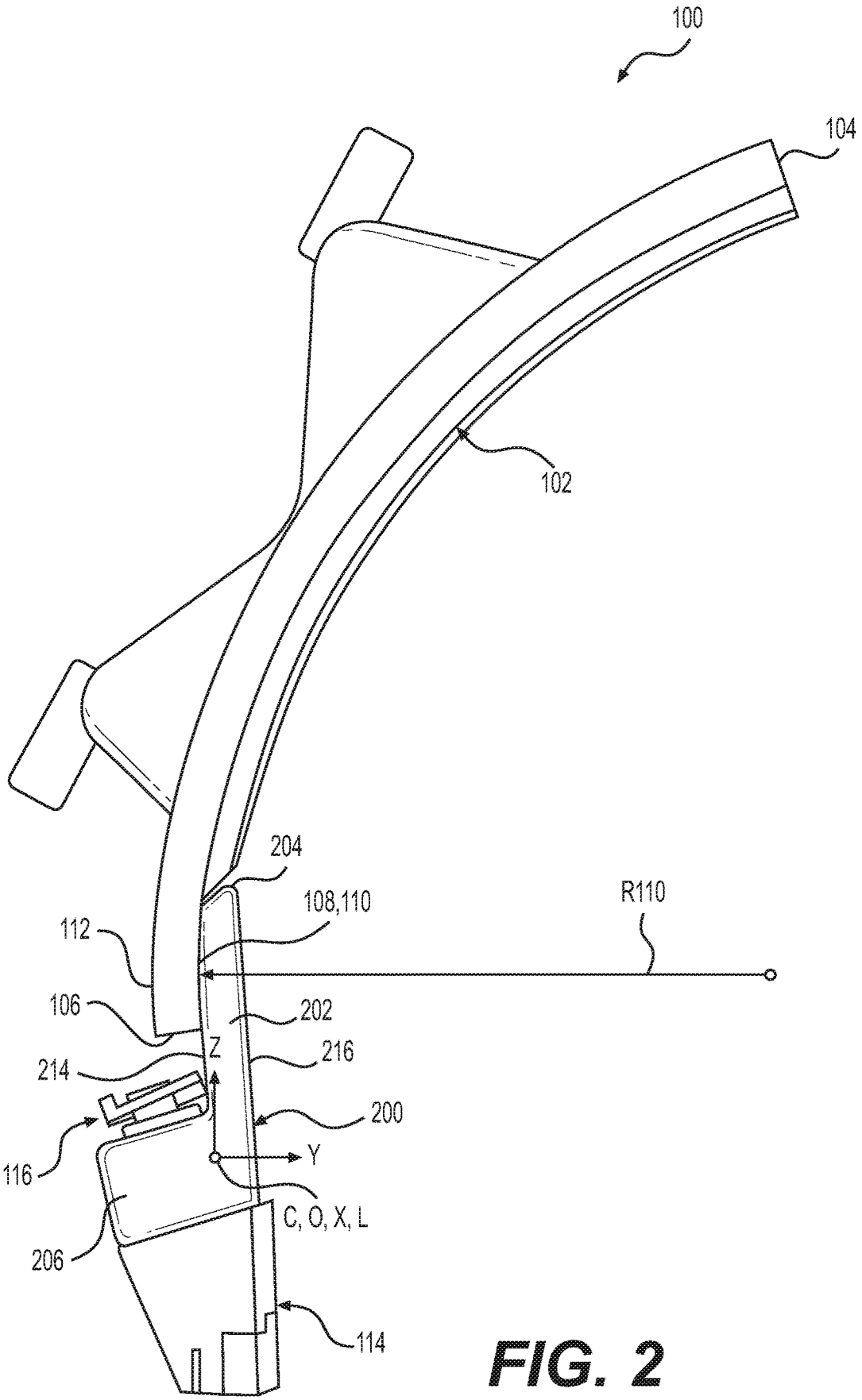
FIG. 2 is a side view of an adapter board with a bolted joint surface mating with a curved moldboard shown in isolation from the machine of FIG. 1.
Figure 3:
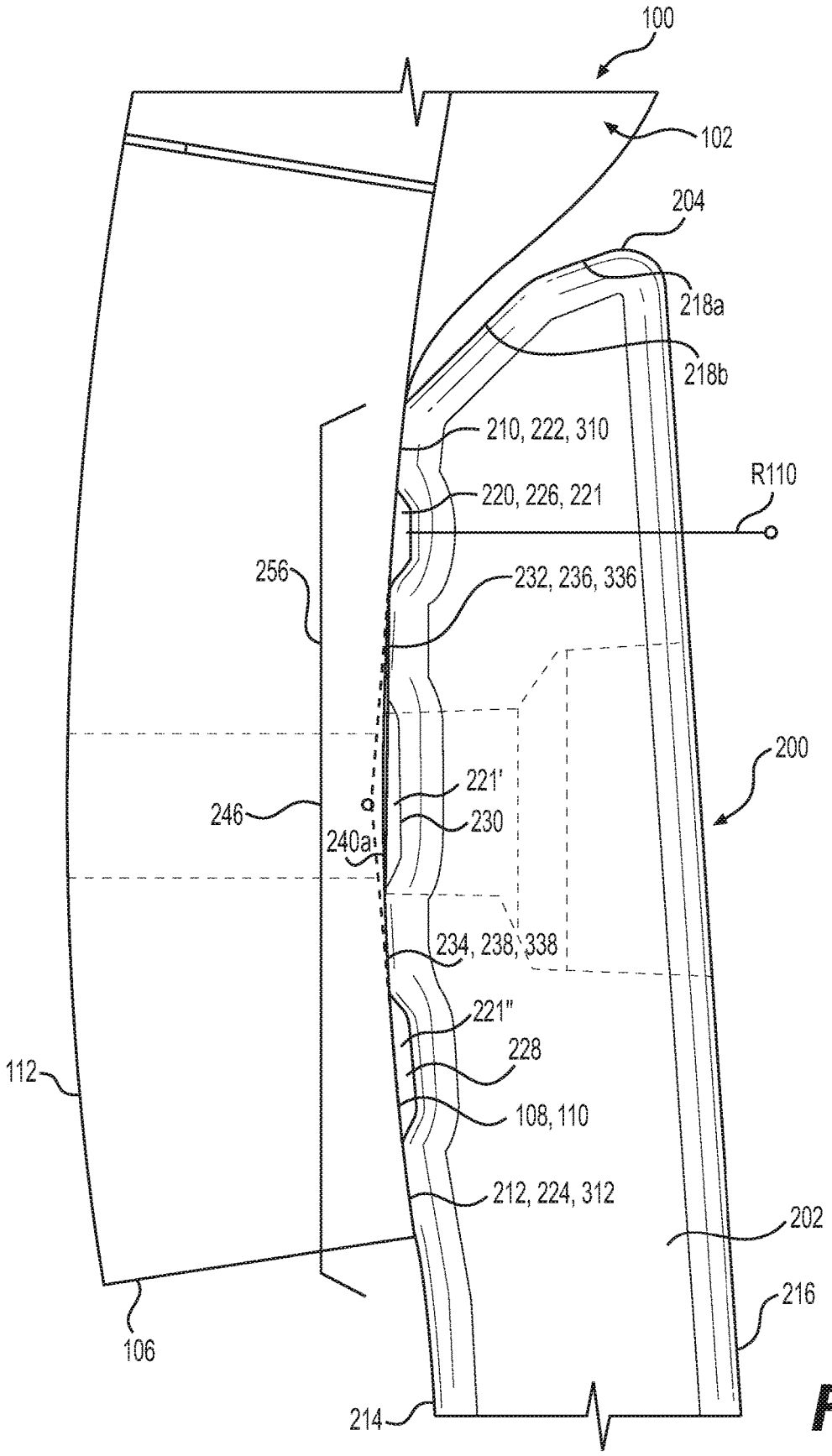
FIG. 3 is an enlarged perspective view of bolted joint surface of the adapter board of FIG. 2, showing the mating of multiple flat ribs against the curved profile of the moldboard more clearly.

Turning now to FIGS. 2 and 3, a blade assembly 100 according to an embodiment of the present disclosure for use with a grading machine 10 such as that shown in FIG. 1 is depicted. The blade assembly 100 may comprise a moldboard 102 defining an upper moldboard free end 104 and a lower moldboard free end 106. The lower moldboard free end 106 defines a lower curved mounting surface 108. For the embodiment shown, the lower curved mounting surface 108 is a front concave mounting surface 110 with a radius of curvature R110 in certain embodiments. However, it is contemplated that the lower curved mounting surface 108 could be a rear convex mounting surface 112 (curved toward the rear) in other embodiments. In either case, the radius of curvature may be varied as needed or desired depending on the application. As used herein, the term "curved" is to be interpreted to be synonymous with "arcuate". A "curved" or "arcuate" surface may include any configuration other than flat, such as radial, elliptical, polynomial, splines, etc.

The blade assembly 100 may further comprise an adapter board 200 defining an upper adapter board attachment portion 202, terminating in an upper adapter board free end 204, and a lower tool bit attachment portion 206, terminating in a lower adapter board free end 208. The upper adapter board attachment portion 202 includes a first peak surface 210 and a second peak surface 212, the first peak surface 210 and second peak surface 212 being configured to contact the lower curved mounting surface 108 of the moldboard 102 and forming a valley 221 therebetween. For this embodiment, the first and second peak surfaces 210, 212 are disposed adjacent the rear flat surface 214 of the upper adapter board attachment portion 202 but it is contemplated that the first and the second peak surfaces 210, 2012 could be disposed on the front flat surface 216 of the upper adapter board attachment portion 202 such as when mating with the rear convex mounting surface 112. The peak surfaces may have any suitable configuration including flat, arcuate, etc.

The first peak surface 210 is disposed adjacent the upper adapter board free end 204 and the second peak surface 212 is disposed adjacent the lower moldboard free end 106. A pair of chamfered surfaces 218*a*, 218*b* are disposed between the first flat surface 210 and the upper adapter board free end 204 to avoid interference between the upper adapter board free end 204 and the moldboard 102 when mounting the adapter board 200 to the moldboard 102.

Figure 4:
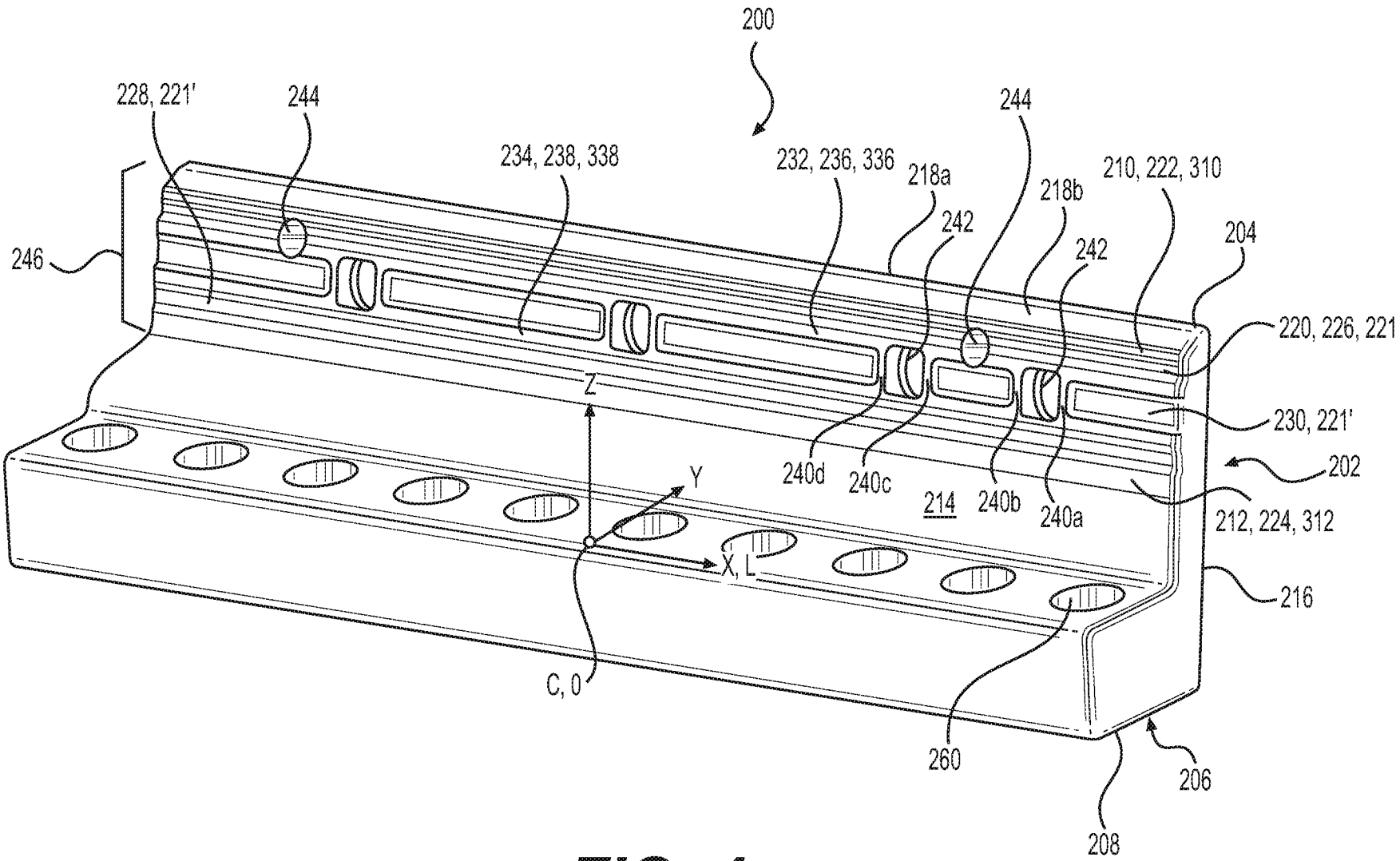
FIG. 4 is a perspective view of the adapter board of FIG. 2 with its peak surfaces designed to mate with the curved profile of the moldboard more clearly shown in isolation from the moldboard and the bits.

As used herein, the terms "upper" and "above" and "lower" and "below" may be best understood using a coordinate system. The adapter board 200 may define a longitudinal axis L, a center of mass C (centroid), a Cartesian coordinate system with an X-axis, Y-axis, and Z-axis, and an origin O disposed at the center of mass C and its X-axis is oriented parallel with the longitudinal axis L. "Upper" and "above" mean along the positive Z-axis, or higher vertically in some contexts while "lower" and "below" mean along the negative Z-axis, or lower vertically in some contexts. The longitudinal axis L is substantially horizontal in many contexts. The first peak surface 210 and the second peak surface 210 extend predominantly parallel with the longitudinal axis L. That is to say, the first peak surface 210 and the second peak surface 212 have dimensions of greatest extent that extend along the X-axis (best seen in FIG. 4). As best seen in FIGS. 3 and 4, the upper adapter board attachment portion 202 defines at least one channel 220 separating the first peak surface 210 and the second peak surface 212, forming a first rib 222 extending parallel with the X-axis, defining the first peak surface 210 and a second rib 224 extending parallel with the X-axis, defining the second peak surface 212.

For the particular embodiment shown in FIGS. 3 and 4, the upper adapter board attachment portion defines a first channel 226 disposed below the first flat surface 210 along a direction parallel with the Z-axis, a second channel 228 disposed above the second flat surface 212 along a direction parallel with the Z-axis, and a third channel 230 disposed between the first channel 226 and the second channel 228 along a direction parallel with the Z-axis, forming a third rib 232 disposed beneath the first rib 222 along a direction parallel with the Z-axis, and a fourth rib 234 disposed above the second rib 224 along a direction parallel with the Z-axis. The relative positioning, sizes, configurations, and number of the ribs 222, 224, 232, 234, the peak surfaces 210, 212 and the channels 226, 228, 230 may be varies as needed or desired depending on the application.

Focusing on FIG. 3, the third rib 232 and the fourth rib 234 extend predominantly along a direction parallel with the X-axis, forming a third peak surface 236, and a fourth peak surface 238. The peak surfaces 210, 212, 236, 238 may not be coplanar with each other in various embodiments. Instead, portions of the peak surfaces 210, 212, 236, 238 may approximate the curvature R110 of the lower curved mounting surface 108.

Returning to FIG. 4, the first channel 226 and second channel 228 extend along the majority of the upper adapter board attachment portion 202 along a direction parallel with the X-axis. The third channel 230 is interrupted by a plurality of cross-ribs 240*a*, 240*b*, 240*c*, 240*d*, etc. connecting the third rib 232 to the fourth rib 234. Also, the upper adapter board attachment portion 202 defines a plurality of bolt holes 242 bounded by the third rib 232, fourth rib 234, and the plurality of cross-ribs 240.

Referring to FIGS. 2 thru 4, the upper adapter board attachment portion 202 is substantially straight and further defines two circular bores 244 (tapped holes to which a lifting eye may be attached) that are in communication with the first channel 226 and the third channel 230. The upper adapter board attachment portion 202 is considered to be substantially straight since the rear flat surface 214 is parallel to the front flat surface 216. Also, the surface area defined by the front flat surface 214 and rear flat surface 216 exceeds the surface area of the undulating mounting surface 246. The upper adapter board attachment portion 202 may be differently configured in other embodiments.

It should be noted that the mounting hardware for mounting the adapter board 200 to the moldboard 102 has been omitted in FIGS. 2 thru 4 for clarity (bolt holes are shown in hidden lines in FIG. 3), but should be understood to be present once assembly is complete. As seen in FIG. 2, tool bits 114 may be mounted to the lower tool bit attachment portion 206 of the adapter board 200 using mounting hardware 116. This arrangement allows adjustment to be made to the tool bits 114 as needed or desired. Tool bit receiving bores 260 are provided that extend completely through lower tool bit attachment portion, allowing the shanks (not clearly shown) of the tool bits 114 to extend therethrough and retain to the adapter board 200 using the mounting hardware 116.

Alternatively, the blade assembly may be characterized as follows with continued reference to FIGS. 3 and 4. The upper adapter board attachment portion 202 may include a plurality of peak surfaces 210, 212, 236, 238 defining a plurality of valleys 221, 221', 221" therebetween. The plurality of peak surfaces 210, 212, 236, 238 may be differently configured than the lower curved mounting surface 108. For example, the lower curved mounting surface 108 may be a radial surface and the peak surfaces 210, 212, 236, 238 may be flat surfaces 310, 312, 336, 328. These flat surfaces 310, 312, 336, 328 may not be parallel or coplanar to each other in various embodiments.

An adapter board 200 for use with a blade assembly 100 of a grading machine 10 according to an embodiment of the present disclosure will now be described by itself with reference to FIGS. 2 thru 4. The adapter board 200 may comprise an upper adapter board attachment portion 202, terminating in an upper adapter board free end 204, and a lower tool bit attachment portion 206, terminating in a lower adapter board free end 208. The upper adapter board attachment portion 202 includes a first flat surface 310 disposed adjacent the upper adapter board free end 204, a second flat surface 312 disposed beneath the first flat surface 310, and a third flat surface 336 disposed below the first flat surface 310 and above the second flat surface 312, the first flat surface 310, the second flat surface 312 and the third flat surface 336 being configured to contact the lower curved mounting surface 108 of a moldboard 102. The various flat surfaces 310, 312 etc. may not be parallel or coplanar with each other in certain embodiments.

The upper adapter board attachment portion 202 further comprises a fourth flat surface 338 disposed above the second flat surface 312 and below the third flat surface 336.

For the embodiment shown in FIGS. 2 thru 4, the upper adapter board attachment portion 202 is substantially straight, forming a rear flat surface 214 disposed beneath the second flat surface 212 that is not parallel or coplanar with the second flat surface.

As mentioned previously, the adapter board 200 may define a longitudinal axis L, a center of mass C (centroid), a Cartesian coordinate system with an X-axis, Y-axis, and Z-axis, and an origin O disposed at the center of mass C and its X-axis may be oriented parallel with the longitudinal axis L. The first flat surface 310 and second flat surface 312 may extend predominantly parallel with the longitudinal axis L. The upper adapter board attachment portion 202 may define at least one channel 220 separating the first flat surface 310 and the second flat surface 312, forming a first rib 222 extending parallel with the X-axis, defining the first flat surface 310 and a second rib 224 extending parallel with the X-axis, defining the second flat surface 312.

More particularly, the upper adapter board attachment portion 202 may define a first channel 226 disposed below the first flat surface 310 along direction parallel with the Z-axis, a second channel 228 disposed above the second flat surface 312 along a direction parallel with the Z-axis, and a third channel 230 disposed between the first channel 226 and the second channel 228 along a direction parallel with the Z-axis, forming a third rib 232 disposed beneath the first rib 222 along a direction parallel with the Z-axis, and a fourth rib 234 disposed above the second rib 224 along a direction parallel with the Z-axis.

The third rib 232 and the fourth rib 234 extend predominantly along a direction parallel with the X-axis, forming the third flat surface 336, and the fourth flat surface 338.

The first channel 226 and the second channel 228 extend along the majority of the upper adapter board attachment portion 202 along a direction parallel with the X-axis and the third channel 230 is interrupted by a plurality of cross-ribs 240 connecting the third rib 232 to the fourth rib 234.

Furthermore, the upper adapter board attachment portion 20 defines a plurality of bolt holes 242 bounded by the third rib 230, the fourth rib 234, and the plurality of cross-ribs 240. The upper adapter board attachment portion 202 may further define two bores 244 that are in communication with the first channel 226 and the third channel 230 and the lower tool bit attachment portion 206 is also substantially straight, forming a "L" shaped configuration with the upper adapter board attachment portion 202 (when viewed from the opposite side of FIG. 2), the lower tool bit attachment portion 206 defining a plurality of tool bit receiving bores 260.

Again, it should be noted that any of the dimensions, surface areas, angles and/or configurations of various features may be varied as desired or needed including those not specifically mentioned herein.

INDUSTRIAL APPLICABILITY

In practice, a machine, a blade assembly, and/or an adapter board a may be manufactured, bought, or sold to retrofit a machine or blade assembly in the field in an aftermarket context, or alternatively, may be manufactured, bought, sold or otherwise obtained in an OEM (original equipment manufacturer) context.

In particular, the adapter board may be cast or forged from any suitable material including iron, grey cast-iron, steel, etc. and then machined to provide various features such as the undulating mounting surface. Specifically, the flat features of the undulating mounting surface may be ground, reducing the cost and eliminating the need for using a five-axis milling machine to machine a curved mounting surface. The channels may act to allow for weight reduction, and to reduce the amount of material needed to be machined to meet desired tolerances. The third rib, fourth rib and the cross-ribs may provide reinforcement for added strength and increased bolt retention about the bolt holes.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

PARTS LIST

| | |
|---|---|
| 100 | blade assembly |
| 102 | moldboard |
| 104 | upper moldboard free end |
| 106 | lower moldboard free end |
| 108 | lower curved mounting surface |
| 110 | front concave mounting surface |
| R110 | radius of 110 |
| 112 | rear convex mounting surface |
| 114 | tool bits |
| 116 | mounting hardware |
| 200 | adapter board |
| 202 | upper adapter board attachment portion |
| 204 | upper adapter board free end |
| 206 | lower tool bit attachment portion |
| 208 | lower adapter board free end |
| 210 | first peak surface |
| 212 | second peak surface |
| 214 | rear flat surface |
| 216 | front flat surface |
| 218a | chamfered surface |

-continued

| PARTS LIST | |
|---|---|
| 218b | chamfered surface |
| L | longitudinal axis |
| C | center of mass |
| X, Y, Z | Cartesian coordinate system |
| O | origin |
| 220 | at least one channel |
| 221 | valley |
| 222 | first rib |
| 224 | second rib |
| 226 | first channel |
| 228 | second channel |
| 230 | third channel |
| 232 | third rib |
| 234 | fourth rib |
| 236 | third peak surface |
| 238 | fourth peak surface |
| 240 | cross-ribs |
| 242 | bolt holes |
| 244 | circular bores |
| 246 | undulating mounting surface |
| 260 | tool bit receiving bores |
| 310 | first flat surface |
| 312 | second flat surface |
| 336 | third flat surface |
| 338 | fourth flat surface |

What is claimed is:

1. An adapter board for use with a blade assembly of a grading machine, the adapter board comprising:

an upper adapter board attachment portion, terminating in an upper adapter board free end; and a lower tool bit attachment portion, terminating in a lower adapter board free end, wherein the upper adapter board attachment portion includes:

a first flat surface disposed adjacent to the upper adapter board free end, a second flat surface disposed beneath the first flat surface, a third flat surface disposed below the first flat surface and above the second flat surface, and a fourth flat surface disposed above the second flat surface and below the third flat surface, the first flat surface, the second flat surface, the third flat surface, and the fourth flat surface being on a same side relative to a longitudinal axis of the upper adapter board attachment portion, the first flat surface and the second flat surface being non-parallel to each other, the third flat surface and the second flat surface being non-parallel to each other, the first flat surface and the third flat surface being separated by a first valley between the first flat surface and the third flat surface, and the second flat surface and the third flat surface being separated by a second valley between the second flat surface and the third flat surface.

2. The adapter board of claim 1, wherein the first flat surface, the second flat surface, the third flat surface and the fourth flat surface are non-parallel to each other.

3. The adapter board of claim 1, wherein the fourth flat surface is non-parallel to the second flat surface.

4. The adapter board of claim 1, wherein the upper adapter board attachment portion defines a third valley, and wherein the third valley is between the first flat surface and the second flat surface.

5. The adapter board of claim 1, wherein the upper adapter board attachment portion defines a third valley disposed between the first valley and the second valley.

6. The adapter board of claim 1, wherein the first valley and the second valley extend along a majority of the upper adapter board attachment portion along an X-axis.

7. The adapter board of claim 1, wherein the upper adapter board attachment portion defines a plurality of bolt holes.

8. The adapter board of claim 1, wherein the lower tool bit attachment portion forms a "L" shaped configuration with the upper adapter board attachment portion, and wherein the lower tool bit attachment portion defines a plurality of tool bit receiving bores.

9. An upper adapter board attachment portion, comprising:

a first flat surface disposed adjacent to an upper adapter board free end;

a second flat surface disposed beneath the first flat surface;

a third flat surface disposed below the first flat surface and above the second flat surface; and a fourth flat surface disposed above the second flat surface and below the third flat surface, the first flat surface, the second flat surface, the third flat surface, and the fourth flat surface being on a same side relative to a longitudinal axis of the upper adapter board attachment portion, the first flat surface and the second flat surface being non-parallel to each other, the third flat surface and the second flat surface being non-parallel to each other, the first flat surface and the third flat surface being separated by a first valley between the first flat surface and the third flat surface, and the second flat surface and the third flat surface being separated by a second valley between the second flat surface and the third flat surface.

10. The upper adapter board attachment portion of claim 9, wherein the first valley is between the second flat surface and the fourth flat surface.

11. The upper adapter board attachment portion of claim 9, wherein the fourth flat surface is non-parallel to the second flat surface.

12. The upper adapter board attachment portion of claim 9, wherein the third flat surface and the fourth flat surface are separated by a third valley.

13. The upper adapter board attachment portion of claim 9, wherein the first valley and the second valley extend along a majority of the upper adapter board attachment portion along an X-axis.

14. The upper adapter board attachment portion of claim 9, wherein the upper adapter board attachment portion defines a plurality of bolt holes.

15. A grading machine, comprising:

a blade assembly; and an adapter board for use with the blade assembly, the blade assembly comprising:

an upper adapter board attachment portion, terminating in an upper adapter board free end; and a lower tool bit attachment portion, terminating in a lower adapter board free end, the upper adapter board attachment portion comprising:

a first flat surface disposed adjacent to the upper adapter board free end, a second flat surface disposed beneath the first flat surface, a third flat surface disposed below the first flat surface and above the second flat surface, and a fourth flat surface disposed above the second flat surface and below the third flat surface, the first flat surface, the second flat surface, the third flat surface, and the fourth flat surface being on a same side relative to a longitudinal axis of the upper adapter board attachment portion, the first flat surface and the second flat surface being non-parallel to each other, the third flat surface and the second flat surface being non-parallel to each other, the first flat surface and the third flat surface being separated by a first valley between the first flat surface and the third flat surface, and the second flat surface and the third flat surface being separated by a second valley between the second flat surface and the third flat surface.

16. The grading machine of claim 15, wherein the lower tool bit attachment portion forms a "L" shaped configuration with the upper adapter board attachment portion.

17. The grading machine of claim 15, wherein the upper adapter board attachment portion defines a plurality of bolt holes.

18. The grading machine of claim 15, wherein the lower tool bit attachment portion defines a plurality of tool bit receiving bores.

19. The grading machine of claim 15, wherein the third flat surface and the fourth flat surface are separated by a third valley.

20. The grading machine of claim 15, wherein the fourth flat surface is non-parallel to the second flat surface.

* * * * *